US005207355A

United States Patent [19]

Thomsen

[11] Patent Number: 5,207,355

[45] Date of Patent: May 4, 1993

[54] HIGH VISCOSITY PUMP SYSTEM FOR DISPENSER POUCH

[76] Inventor: Peter N. Thomsen, 100 North Hill Dr., No. 28, Brisbane, Calif. 94005

[21] Appl. No.: 814,763

[22] Filed: Dec. 30, 1991

[51] Int. Cl.[5] ..... B65D 35/28

[52] U.S. Cl. ..... 222/95; 222/105; 222/207; 222/214

[58] Field of Search ..... 222/95, 103, 105, 207, 222/209, 214, 215

[56] References Cited

U.S. PATENT DOCUMENTS

| | | | |
|---|---|---|---|
| 3,009,498 | 11/1961 | Fohr | 150/9 |
| 3,184,121 | 5/1965 | Vokekening | 222/213 |
| 3,741,439 | 6/1973 | Vehrs | 222/103 |
| 3,815,794 | 6/1974 | Carlisle | 222/491 |
| 3,994,393 | 11/1976 | Nilson | 222/207 X |
| 4,252,257 | 2/1981 | Herzig | 222/213 |
| 4,463,879 | 8/1984 | Swallert | 222/207 X |
| 4,570,827 | 2/1986 | Roggenburg, Jr. et al. | 222/95 |
| 4,573,612 | 3/1986 | Maddison et al. | 222/94 |
| 4,634,022 | 1/1987 | O'Halloran et al. | 222/95 |
| 4,823,990 | 4/1989 | Roggenburg et al. | 222/207 |
| 4,921,136 | 5/1990 | Roggenburg, Jr. | 222/95 |
| 5,000,350 | 3/1991 | Thomsen | 222/103 |
| 5,067,635 | 11/1991 | Thomsen | 222/103 |

FOREIGN PATENT DOCUMENTS

| | | | |
|---|---|---|---|
| 735289 | 5/1966 | Canada | 222/107 |

*Primary Examiner*—Andres Kashnikow
*Assistant Examiner*—Kenneth Bomberg
*Attorney, Agent, or Firm*—Phillips, Moore, Lempio & Finley

[57] ABSTRACT

A dispensing pouch comprises a pair of superimposed panels sealed together to define a reservoir, adapted to contain a high viscosity liquid therein. A spout is formed on a lower end of the pouch and has a pump disposed therein that defines a charging chamber, communicating with the reservoir, to retain a pre-measured charge of the liquid therein. The liquid is discharged from the charging chamber in response to the external application of pumping pressure onto an outer side of the spout. The pouch is adapted for mounting in a dispensing unit, having a dual-action pressure plate, for periodically pumping and dispensing the pre-measured charge of liquid from the charging chamber of the pump. The pump is preferably defined by a separate insert, sandwiched between the panels of the pouch. A method for making the pouch is also disclosed.

13 Claims, 3 Drawing Sheets

HIGH VISCOSITY PUMP SYSTEM FOR DISPENSER POUCH

TECHNICAL FIELD

This invention relates generally to a dispenser pouch adapted to contain a high viscosity liquid therein and more particularly to a sealed pouch having a pump adapted to dispense a pre-measured charge of liquid therefrom when an external pumping pressure is applied to the pouch.

BACKGROUND OF THE INVENTION

Conventional dispensers for liquids having relatively high viscosities, such as heavy duty soaps, shampoos, tomato ketchup, mayonnaise, tooth paste, high viscosity oils or the like, oftentimes take the form of a semi-rigid plastic container having an openable closure cap or a reciprocal dispensing valve mounted thereon. Conventional dispensers of this type are relatively expensive to manufacture, are prone to malfunction and leakage and normally do not insure that a pre-measured charge of the liquid will be efficiently dispensed therefrom.

Other types of conventional dispensers include thin-walled plastic pouches that are heat sealed to retain a liquid product therein. A corner of the pouch is either ripped open to dispense the product or a closure plug is used for this purpose. Further, U.S. Pat. Nos. 3,009,498; 3,184,121; 3,815,794; and 4,252,257 and Canadian Patent No. 735,289 disclose pouches or bags which provide various types of closures to seal the bags after product has been dispensed therefrom. Bags of this type are incapable of efficiently dispensing relatively high viscosity liquids (e.g., 3,000 to 14,000 centipoises) and require mechanical manipulation or other extraneous forces to open and close the valves thereof.

The dispenser pouches disclosed in applicant's U.S. Pat. Nos. 5,000,350 and 5,067,635 have solved the above prior art problems by providing systems that function efficiently to dispense liquids having a wide variety of viscosities. However, when liquids having relatively high viscosities (e.g., in excess of 3,000 centipoises) were used in the so called deep-drawn pouch of the type shown in FIGS. 4 and 5 of U.S. Pat. No. 5,000,350, the dispensing efficiency of the pouch was found to lessen when the contents of the pouch approached empty.

DISCLOSURE OF INVENTION

An object of this invention is to provide a dispenser pouch that will repeatedly dispense pre-measured charges of liquid in a controlled and efficient manner.

The dispenser pouch comprises a pair of panels defining a reservoir adapted to contain a liquid therein and a spout formed on a lower end of the pouch. A pump is disposed in the spout and defines a charging chamber for retaining a pre-measured charge of the liquid prior to dispensing thereof from the pouch. The pump functions to dispense the charge of liquid from the charging chamber in response to external application of pumping pressure thereon.

In another aspect of this invention, the pump is defined by a separate insert, sandwiched between the panels of the pouch.

In still another aspect of this invention, the preferred pouch embodiment of this invention is mounted in a dispensing unit of the general type disclosed in my U.S. Pat. No. 5,000,350. The dispensing unit comprises dispensing mechanism for engaging and applying pumping pressure to the pump to dispense the pre-measured quantity of liquid from the charging chamber for consumption purposes.

BRIEF DESCRIPTION OF THE DRAWINGS

Other objects and advantages of this invention will become apparent from the following description and accompanying drawings wherein.

DESCRIPTION OF THE PREFERRED EMBODIMENT

Figure 1:
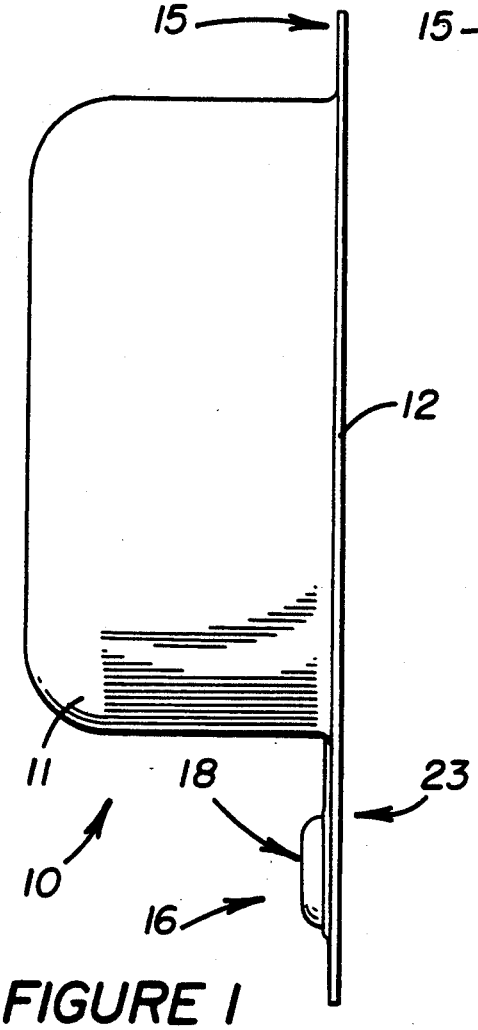
FIG. 1 is a side elevational view of a dispenser pouch embodying this invention.

FIGS. 1–4 illustrate a dispensing pouch 10 comprising a pair of superimposed panels 11 and 12. Common numerals depict components and constructions corresponding to like-numbered ones disclosed in my U.S. Pat. Nos. 5,000,350 and 5,067,635. The pouch defines a reservoir 13 (FIG. 2) adapted to contain a high-viscosity liquid product therein, such as soap, shampoo, tomato ketchup, mayonnaise, heavy duty oil, or other suitable product in liquid form.

In the preferred embodiment of this invention, panels 11 and 12 constitute a pair of separate composite plastic sheets (e.g., nylon/polyethylene laminate, 6 to 8 mils thick) superimposed over each other during manufacture and heat-sealed together substantially about their peripheries, as depicted at side seams 14 and 14'. An upper end 15 of the dispenser pouch may be left open during initial stages of the packaging process to initially fill the pouch with a liquid product whereafter the end is heat-sealed. Alternatively, flat panel 12 could be heat-sealed to deep-drawn panel 11 after the reservoir is filled with product. As described hereinafter, a pump system 16 is combined with the type of dispenser pouch described in my above-referenced patents to insure efficient dispensing of the high viscosity product packaged therein.

One or more holes 17 can be formed through the upper seam of the pouch to adapt it for mounting purposes, as also described in m above-referenced patents. A lower end of the pouch is preferably closed during manufacture by sealed panel portions forming a removable closure portion (not shown). . The closure portion can be snipped-off by scissors, for example, when the dispenser pouch is placed in use by a consumer.

Each panel 11 and 12 is preferably composed of co-extruded composite plastic materials of the types described in my afore-mentioned patents, the disclosures of which are incorporated by reference herein. Individual thicknesses and compositions of the panels will vary, depending on the particular consumer product application under consideration. The composite thickness of each panel is preferably selected from the approximate range of from 3.0 to 10.0 mils for most home and industrial pouch applications and the pouches are adapted to contain from 50 ml to 5,000 ml of a liquid product in reservoir 13. Further, it is contemplated that most of the dispenser pouches would have a total length in the approximate range of from 10.0 cm to 36.0 cm and an internal maximum width of reservoir 13 (between seams 14 and 14' in FIG. 2) of from 5.0 cm to 12.0 cm.

Pump systems 16 comprises a separate one-piece and button-like insert 18 (FIG. 5) that is sandwiched between panels 11 and 12. If so desired, diametrically opposed peripheral portions 19 of the pre-formed insert (FIG. 2) can be heat-sealed to at least one of the panels and preferably between the panels, after the insert has been dropped into the like-shaped recess formed in panel 12, when flat panel 12 is heat-sealed to panel 11. The pump system is adapted to dispense relatively high viscous liquids from the pouch in response to application of pumping pressure thereto, as described hereinafter with reference to FIGS. 7–9.

The insert may be composed of polyethylene, rubber or other suitable material having sufficient thickness and other dimensional, physical and mechanical (e.g., durometer hardness of from 60 to 80) properties to effect the desired pumping action. The pre-formed insert, shown in its normally relaxed condition in FIGS. 1–5, defines a charging chamber 20 communicating with a plurality of passages or slots 21, formed circumferentially through an underside of an annular mounting flange 22 of the insert. The charging chamber is adapted to retain a pre-measured charge of liquid therein with the chamber being defined by the centrally disposed bulbous portion of the insert and the opposing inner surface portions of panel 12.

Figure 2:
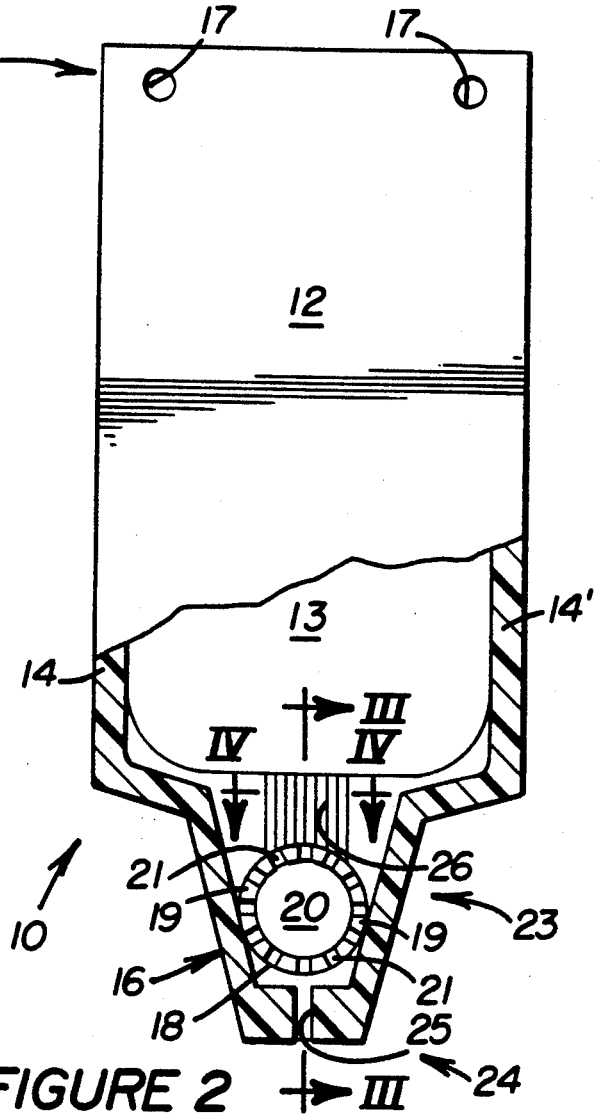
FIG. 2 is a front elevational view of the dispenser pouch with a portion of a flat panel 12 thereof being broken-away to expose a reservoir and pump system therein.

When the bulbous portion of the insert is compressed externally through overlying panel 11, the resulting pumping action is sufficient to dispense the liquid from the charging chamber, through the lower-most slots 21 (FIG. 2). Release of the pumping pressure will permit the bulbous portion of the insert to reassume its normally expanded condition, illustrated in FIGS. 1–5, to ready the dispenser pouch for the next-following dispensing function. Simultaneously with automatic expansion of the insert, the relative decrease in pressure (partial vacuum) in chamber 20, aided by gravity feed (the dispenser pouch is normally mounted vertically), will function to recharge chamber 20 with a pre-measured charge of liquid from reservoir 13.

Figure 3:
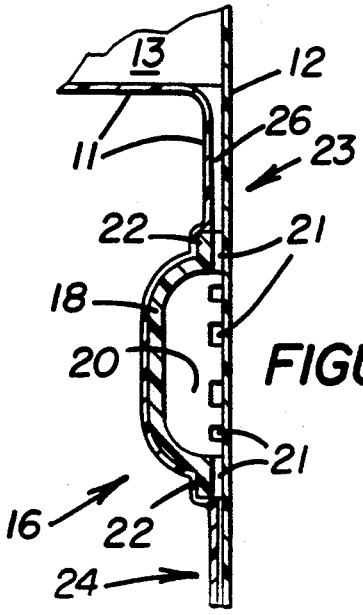
FIG. 3 is an enlarged sectional view through the pouch, taken in the direction of arrows III—III in FIG. 2.
Figure 4:
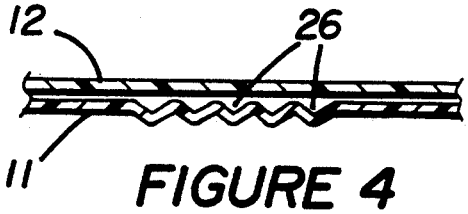
FIG. 4 is an enlarged sectional view, taken in the direction of arrows IV—IV in FIG. 2.
Figure 5:
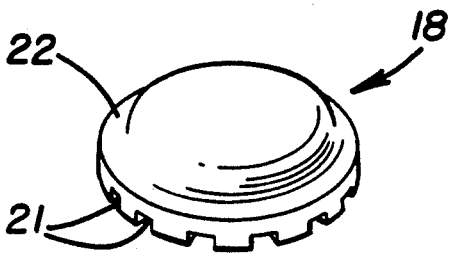
FIG. 5 is an isometric view of an insert adapted for assembly with the pouch to form the pump system thereof.

In the preferred embodiment of this invention, the bulbous portion of the insert is at least generally semi-spherical (FIGS. 3 and 5). Further, although the pump system of this invention is adapted for use with the type of pouch disclosed in U.S. Pat. No. 5,067,635, it is preferably utilized with the type of pouch disclosed in U.S. Pat. No. 5,000,350 wherein panel 11 is deep-drawn to assume its illustrated expanded condition on one side of the pouch and panel 12 is at least substantially flat. The cavity defined in panel 11, conforming to the outer shape of insert 18, is also pre-formed during a deep-drawing step in the method for making the pouch.

Referring to FIGS. 1–4, pump system 16 is disposed in a downwardly tapered neck or spout 23 of the dispenser pouch. As described in applicant's above-referenced patents, the spout terminates at its lower end at a valve 24, including a normally closed passage 25 (FIG. 2) that forms an outlet from the pouch communicating with the lowermost outlet passages 21 from pump system 16. Passage 25 is preferably rectangular and straight and is defined by overlying portions of panels 11 and 12 that are normally flattened and compressed together to close the valve.

Spout 23 defines a plurality of waffle-like parallel passages 26 pre-formed in panel 11 for communicating with reservoir 13 to aid in the periodical communication of the pre-measured charge of liquid to charging chamber 20 of pump system 16. The composite cross-sectional area of passages 26, defining an inlet to chamber 20, is substantially larger (e.g., four times) than the cross-sectional area of outlet passage 25. When the dispenser pouch is mounted vertically for use, as described in detail hereinafter, the high viscosity product retained in reservoir 13 and charging chamber 20 will not leak since valve 24 is normally closed. Compression of the bulbous portion of insert 18 (FIG. 9) will function to open valve 24 to dispense the contents from charging chamber 20.

Upon release, the insert will exhibit sufficient spring-back characteristics and "memory" to enable the insert to reassume its normally expanded condition illustrated in FIGS. 1–5, as will be appreciated by those skilled in the packaging arts. Simultaneously therewith, a negative pressure (partial vacuum) will be created in charging chamber 20 (valve 24 closing automatically to prevent exposure of the chamber to ambient air pressure). Thus, another predetermined charge of liquid will be communicated from reservoir 13 and into chamber 20, via passages 26 and any clearance existing between panels and flange 22 (FIG. 3). The efficient operation of the pump system will insure that at least substantially all of the packaged product can be used by a consumer.

Figure 6:
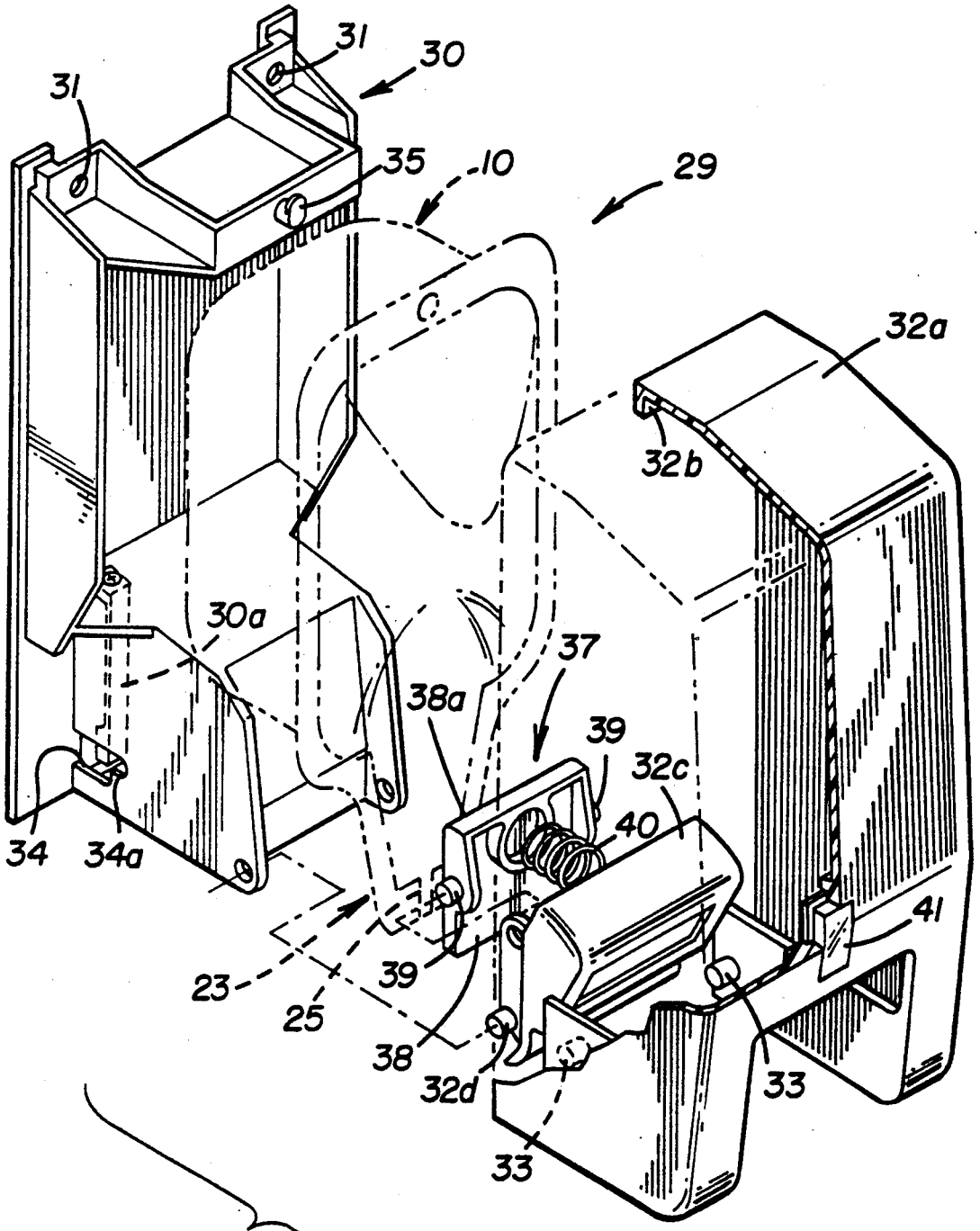
FIG. 6 is an exploded isometric view of the dispensing unit, more fully described in applicant's U.S. Pat. No. 5,000,350.

FIG. 6 illustrates a combined and dispensing unit 29 of the type disclosed in U.S. Pat. No. 5,000,350. The unit comprises a mounting bracket 30 adapted to be secured on a wall or the like by a standard adhesive or by other suitable fastening means inserted through holes 31 formed through the back panel of the bracket. A first cover portion **32*a* of a two-part cover is pivotally mounted on a lower end of the mounting bracket by a pair of transversely disposed pins 33, mounted in slots 34. A flange 32*b* is formed centrally on an upper end of cover portion 32*a* to normally hold it in a fixed position on the mounting bracket, along with a cantilevered leaf spring 30*a* (one shown) that normally overlies each pin 33**.

Finger holes (not shown) are formed through a bottom wall of the mounting bracket to facilitate release of springs **30*a* from pins 33 in the manner described in U.S. Pat. No. 5,000,350. In particular, cover portion 32*a* can be lifted, moved forwardly and upwardly into a slot portion 34*a*, and then pivoted outwardly and downwardly on pins 33 to expose phantom-lined pouch 10. A mounting pin 35 is secured on the frontal side of mounting bracket 30 to removably mount pouch 10 thereon. If so desired, a pair of laterally spaced pins and accommodating holes 17 (FIG. 1**) can be used for this purpose.

The cover further comprises a second cover portion or press plate 32*c*, pivotally mounted by pins 32*d* (one shown) on bracket 30. When press plate 32*c* is pushed down, toward mounting brackets 30 for dispensing purposes as sequentially shown in FIGS. 7–9, a compression means 37 will function to compress and apply a descending pumping pressure onto pump system 16 to open valve 24 (FIG. 9) and dispense the pre-measured charge of liquid product from charging chamber 20. The compression means comprises a cam member or pressure plate 38 pivotally mounted by a pair of pins 39 on inner sides of press plate 32*c*.

An upper end of the pressure plate is normally spring-biased into relatively "light" and non-dispensing contact with the pouch by a compression coil spring 40. As sequentially shown in FIGS. 7–9, application of hand or finger pressure to press plate 32*c* will pivot the press plate on pins 32*d*. An upper edge 38*a* of pressure plate 38 will initially move into line contact with the upper end of spout 23, across passages 26, to block further entry of liquid into the charging chamber. The motion of the cam member generally mimics the application of descending finger pressure onto spout 23 for dispensing purposes, i.e., a milking type action.

Figure 9:
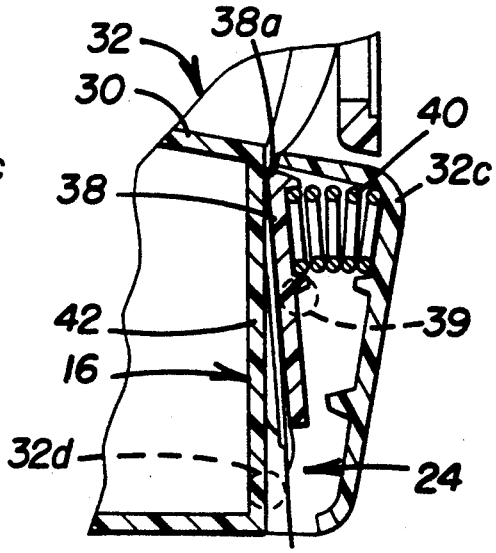

As shown in FIG. 9, continued application of pressure to press plate 32*c* will function to pivot pressure plate 38 about edge 38*a* to completely exhaust charging chamber 20. Upon release of the press plate, spring 40 will return the press and pressure plates to their FIG. 7 normal positions. Charging chamber 20 will then fill automatically, via passages 26, slots 21 and any clearance existing between the panels and flange 22 (FIG. 3) to ready the unit for a subsequent dispensing function. A sight window 41 (FIG. 6) can be mounted centrally in Cover portion 32*a* to visually indicate the diminished quantity of liquid remaining in transparent pouch 10.

Figure 7:
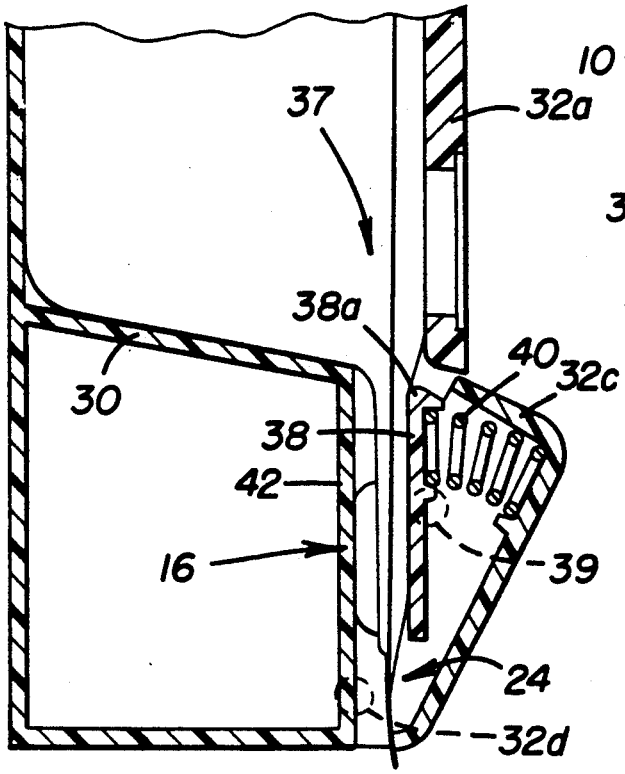
FIGS. 7–9 are partial sectional views illustrating the sequential application of pumping pressure to the pump system of the dispenser pouch, mounted in a dispensing unit.
Figure 10:
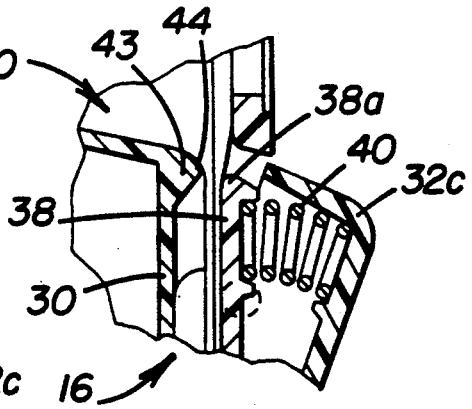
FIG. 10 illustrates a modification to the dispensing unit.
Figure 8:
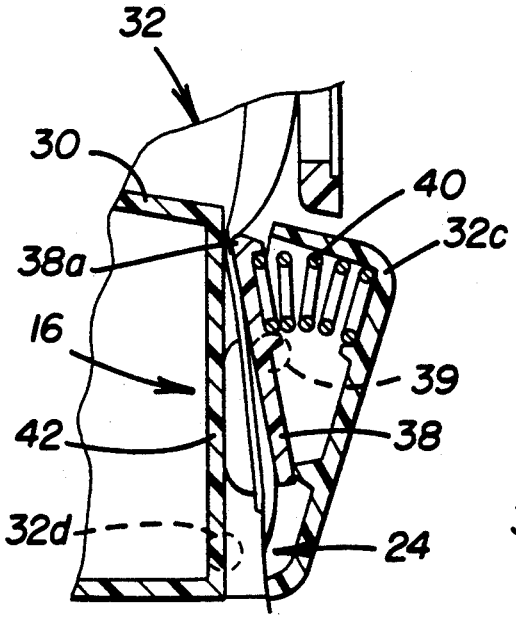

As more clearly shown in FIGS. 7–9, mounting bracket 30 has a stationary back-up plate 42 formed integrally thereon. If so desired and as shown in FIG. 10, pinch-off means in the form of a stop member 43 can be secured on the back-up plate, for more closely controlling the precise closing of the inlet to chamber 20 from reservoir 13 in response to downward pivoting of pressure plate 38. The stop member may have a wedge-shaped cross-section terminating at its apex at a straight edge 44 to define a line contact and closure across the full widths of spout 23 and stop member 43 when the dispensing function is commenced. The panel material forming the corrugated portion of the pouch defining passages 26 will exhibit sufficient "memory" characteristics to permit the passages to reassume their normal fully open condition when pumping pressure is removed from the pouch.

Normally closed valve 24 is preferably similar to that described in applicant's U.S. Pat. Nos. 5,000,350 and 5,067,635, but can be sized and constructed to normally remain "slightly" open. In the latter case, the size (cross-sectional area and length) of outlet passage 25 would be matched against the viscosity of the particular liquid that is packaged in the dispenser to prevent any leakage. In particular, the viscosity of such liquid would be sufficiently high to prevent leakage thereof through the outlet passage when the dispenser assumes its normal predispensing condition (FIG. 7), prior to activation of pump system 16.

Figure 11:
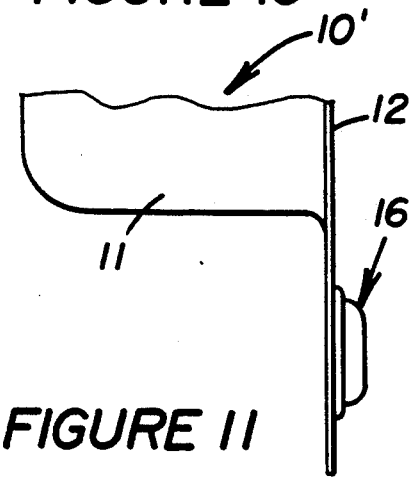
FIG. 11 is a partial view, similar to FIG. 1, illustrating a modified pouch.

FIG. 11 discloses a modified dispenser pouch 10' wherein the cavity for accommodating insert 18 is preformed in panel 12, rather than panel 11. Pump system 16 is thus exposed for contact and compression on the opposite side of the modified pouch. Waffle-like passages can be formed in either panel 12 (FIG. 11) or panel 11 (FIGS. 1–4). The modified pouch can be mounted in dispensing unit 29 (FIG. 6) to function in the same manner as above-described pouch 10.

I claim:

1. A pump system in combination with a dispenser pouch comprising a pair of overlying panels defining a reservoir adapted to contain a liquid therein and a spout on a lower end of said pouch, said pump system comprising pump means entirely disposed in said spout, including a separate button-like insert having a bulbous portion disposed in a like-shaped recess defined in one of said panels of said spout, for dispensing said liquid from said pouch in response to the application of pumping pressure thereto, charging chamber means, defined within said insert for retaining a pre-measured charge of said liquid therein, inlet passage means within said spout for communicating liquid from said reservoir to automatically recharge said charging chamber means with said pre-measured charge of liquid in response to release of pumping pressure from said pump means, outlet means for dispensing said pre-measured charge of liquid from said charging chamber means in response to said application of pumping pressure to said pump means, and normally closed valve means, defined by and between said panels at said outlet means, for opening automatically in response to said application of said pumping pressure to said pump means.

2. The combination of claim 1 wherein said panels are sealed together about peripheral portions thereof and wherein said pump means is defined by said separate insert which is sandwiched between said panels.

3. The combination of claim 2 wherein peripheral portions of said insert are heat sealed to at least one of said panels.

4. The combination of claim 2 wherein said bulbous portion is centrally disposed on said insert.

5. The combination of claim 4 wherein said bulbous portion is generally semi-spherical.

6. The combination of claim 1 wherein said inlet passage means has a cross-sectional area substantially larger than a cross-sectional area of said outlet means.

7. The combination of claim 1 wherein only one of said panels is expanded on only one side of said pouch to define said reservoir and the other one of said panels is substantially flat.

8. The combination of claim 1 further comprising a dispensing unit including a mounting bracket having said dispenser pouch mounted thereon, a cover mounted on said mounting bracket to at least substantially cover said dispenser pouch, and dispensing means for engaging and applying said pumping pressure to said pump means to selectively dispense said pre-measured charge of liquid from said charging chamber means.

9. The combination of claim 8 wherein said dispensing means comprises a pivotally mounted press plate forming a bottom portion of said cover covering said charging chamber and pressure plate means pivotally mounted on said press plate for engaging and compressing said pump means in response to pivoting of said press plate.

10. The combination of claim 9 further comprising a stationary back-up plate and wherein said pump means is disposed between said pressure plate means and said back-up plate.

11. The combination of claim 9 further comprising pinch-off means for closing said inlet passage means in response to pivoting of said press plate.

12. The combination of claim 1 wherein said pinch-off means comprises stop means mounted on said back-up plate for defining a line contact and closure between said pouch and said stop means in response to pivoting of said press plate.

13. A pump system in combination with a dispenser pouch comprising a pair of overlying panels defining a reservoir adapted to contain a liquid therein and a spout on a lower end of said pouch, said pump system comprising pump means disposed in said spout for dispensing said liquid from said pouch in response to the application of pumping pressure thereto, charging chamber means for retaining a pre-measured charge of said liquid therein, inlet passage means for communicating liquid from said reservoir to automatically recharge said charging chamber means with said pre-measured charge of liquid in response to release of pumping pressure from said pump means, outlet means for dispensing said pre-measured charge of liquid from said charging chamber in response to said application of pumping pressure to said pump means, and, a dispensing unit including a mounting bracket having said dispenser pouch mounted thereon, a cover mounted on said mounting bracket to at least substantially cover said dispenser pouch, and dispensing means for engaging and applying said pumping pressure to said pump means to selectively dispense said pre-measured charge of liquid from said charging chamber means, said dispensing means comprising a pivotally mounted press plate forming a bottom portion of said cover covering said charging chamber and pressure plate means pivotally mounted on said press plate for engaging and compressing said pump means in response to pivoting of said press plate.

* * * * *